US007041967B2

(12) United States Patent
Hager

(10) Patent No.: US 7,041,967 B2
(45) Date of Patent: May 9, 2006

(54) METHOD OF MASS SPECTROMETRY, TO ENHANCE SEPARATION OF IONS WITH DIFFERENT CHARGES

(75) Inventor: James W. Hager, Mississauga (CA)

(73) Assignee: MDS Inc., Concord (CA)

( * ) Notice: Subject to any disclaimer, the term of this patent is extended or adjusted under 35 U.S.C. 154(b) by 0 days.

(21) Appl. No.: 09/942,586

(22) Filed: Aug. 31, 2001

(65) Prior Publication Data

US 2002/0175279 A1 Nov. 28, 2002

Related U.S. Application Data

(60) Provisional application No. 60/293,161, filed on May 25, 2001.

(51) Int. Cl.
*H01J 49/26* (2006.01)

(52) U.S. Cl. ..... 250/282; 250/292

(58) Field of Classification Search ..... 250/282, 250/288

See application file for complete search history.

(56) References Cited

U.S. PATENT DOCUMENTS 5,696,376 A * 12/1997 Doroshenko et al. ..... 250/292
5,783,824 A * 7/1998 Baba et al. ..... 250/281
5,847,386 A 12/1998 Thomson et al.
5,952,653 A 9/1999 Covey et al. ..... 250/288
6,177,668 B1 1/2001 Hager ..... 250/282
6,188,066 B1 * 2/2001 Whitehouse et al. ..... 250/288

FOREIGN PATENT DOCUMENTS

WO WO 98/52209 11/1998

OTHER PUBLICATIONS

Tolmachev, et al., "Rapid Communication", Mass Spectrometry 14, pp. 1907-1913, 2000.
D. Gerlich, "Advances in Chemical Physics", vol. LXXXII, pp. 1-176, 1992.
Kristina Stenstrom et al., "Application of Accelerator Mass Spectrometry (AMS) for High-sensitivity Measurements of 14CO2 in Long-term Studies of Fat Metabolism", pp 417-422, Appl. Radiat. Isot. vol. 47, No. 4, 1996.

* cited by examiner

*Primary Examiner*—Nikita Wells
*Assistant Examiner*—Phillip A. Johnston
(74) *Attorney, Agent, or Firm*—Bereskin & Parr

(57) ABSTRACT

A method of analysing ions provides for separating ions with different charge states. Ions are first thermalized to have substantially the same energy, preferably in an ion trap. Then a barrier height is set to enable ions having a lower charge to escape, while retaining ions with higher charge states. Having effected separation of the ions either or both groups of ions can be subjected to various conventional mass analysis or other processing steps.

23 Claims, 7 Drawing Sheets

Figure 1: Apparatus

Figure 2: Survey MS Scan Function

Figure 4: Multiply Charged Enhanced Scan Function
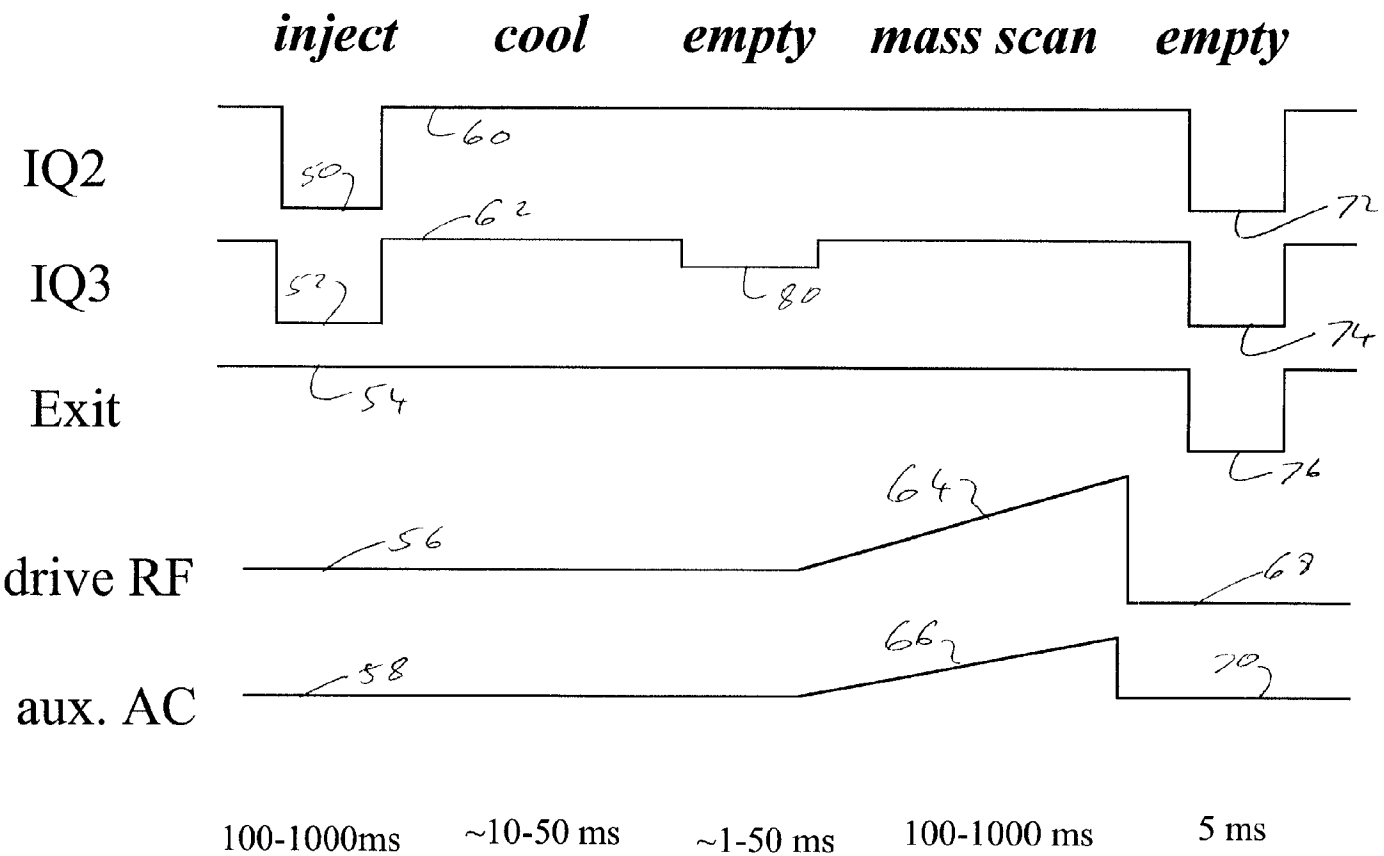

METHOD OF MASS SPECTROMETRY, TO ENHANCE SEPARATION OF IONS WITH DIFFERENT CHARGES

FIELD OF THE INVENTION

This invention relates to a mass spectrometry method and apparatus. More particularly, this invention relates a mass spectrometry technique enabling, or at least enhancing, separation of ions with different charges.

BACKGROUND OF THE INVENTION

Mass spectrometry is now a well-established technique for analyzing substances by separating ions due to their differing mass to charge ratios. A wide variety of mass spectrometers and ionization techniques are known. The present invention is particularly, although not exclusively, concerned with electrospray-generated ions, and more particularly the use of this ionization technique with large organic molecules.

Mass spectrometry of electrospray-generated ions is a very sensitive technique for identification and quantification of trace compounds at low concentrations. In particular, it is now known that electrospray ionization techniques generate multiply charged ions allowing analysis with mass spectrometers with limited mass ranges. Many organic compounds can be ionized so to have multiple charges. For example, multiply charged ions of peptides formed from protein digestion by the enzyme trypsin have been shown to be useful for sequence determination following product ion MS/MS scans, as is described by Covey et. al. in U.S. Pat. No. 5,952,653. A product ion scan is now a well known analysis technique in mass spectrometry, in which a precursor ion is selected, caused to fragment (usually by acceleration into a collision cell), and then the fragments are scanned to determine the fragments or products generated from the selected precursor, which can give information about the structure of the precursor. One difficulty however is that it can be a challenge to identify low concentration multiply charged peptides in the single MS survey scan due to the presence of singly charged chemical noise that is often present in such scans. MS/MS techniques such as precursor ion and neutral loss scanning can partly offset the chemical noise problem by introducing an additional degree of specificity to the survey scans (a precursor ion scan holds the selected product or fragment ion mass to charge ratio fixed and scans to identify precursor ions that generate such the selected product of fragment ion; a neutral ion scan maintains a fixed mass difference between a selected precursor ion and a selected product/fragment ion). The utility of these scans however requires some prior knowledge of the sample, which is not always the case. For example, to carry out a meaningful precursor scan, it is necessary to have some knowledge of fragment ions that might be generated. Thus, analysis of analytes that produce multiply charged fragment ions can generate some unique problems.

Linear ion traps have been reported to discriminate against higher m/z ions under conditions in which the overall charge density is high. This is due to the fact that, at a given RF voltage or trapping q-value, the potential wells for higher m/z ions are shallower than those for ions with lower m/z values [Tolmachev et. al. Rapid Commun. Mass Spectrom. 14, 1907–1913(2000)]. This is true for both linear ion traps with two-dimensional radio frequency trapping fields and conventional ion traps with three-dimensional trapping fields. However, this does not address the problem of differentiating between multiply charged ions (often desired analyte ions) and singly charged ions (often unwanted chemical noise) with the same m/z. The inventor of the present invention has found that the population of multiply charged ions of a given m/z can be enhanced relative to the population of singly charged ions at the same m/z. This then makes it possible to identify low concentration multiply charged ions in what would normally be much more concentrated singly charged chemical noise.

SUMMARY OF THE INVENTION

Accordingly it is desirable to provide a method that enables multiply charged and singly charged ions of the same m/z to be distinguished from one another.

The present invention provides a method for enhancing the appearance of multiply charged ions in the single MS survey scan by first ensuring the ions have substantially similar energies, preferably by collisional cooling, and then differentiating between the different ions by an energy barrier. These steps are preferably carried out in an ion trap, most preferably when utilizing a linear ion trap. The technique involves first allowing the trapped ions to cool via collisions with a background gas to the point where singly and multiply charged ions have the similar kinetic energies. Subsequently a normally repulsive DC barrier voltage at one end of the linear ion trap, previously used to maintain the trap, is reduced to a level where the singly charged ions are allowed to escape while the multiply charged ions remain trapped. Experimental results detailed below, show a dramatic reduction in the number of trapped singly charged ions with little loss of the multiply charged ion population. This method allows rapid identification of multiply charged ion fragments or products that can then be further subjected to MS/MS scans, such as product ion, precursor or neutral loss scans, to allow, at least for peptides and proteins, sequence information to be obtained.

In accordance with a first aspect of the present invention, there is provided a method of analyzing ions, whereby the method comprising:

(1) providing a stream of ions; and (2) providing, in an ion processing section, an energy barrier, having a magnitude between at least a first group of ions having a first charge and a second group of ions having a second, higher charge, whereby said at least a first group of ions are emptied from the ion processing section and the second group of ions are retained in the ion processing section for subsequent processing.

In the most general case, either one or both of the first and second groups of ions can be subject to a mass analysis step, or other processing, i.e. fragmentation followed by mass analysis. As the first group of ions are necessarily emptied from the ion trap, any further processing or mass analysis must be effected outside of the trap. The second group of ions can be further processed in the trap (i.e. by scanning out by axial ejection, to effect mass analysis) or transferred to other devices for further processing.

It will also be understood that where there are a large number of different multiply charged ion species, the energy barrier can be set initially at any number of different levels. For example, it may be desired to eject singly and doubly charged ions and just retain triply and greater charged ions, instead of ejecting just the singly charged ions. In this situation a further alternative is to progressively eject or empty each group of ions with a different charge, e.g. first singly charged ions, then doubly charged ions etc., so that each group of ions can be subject to individual secondary processing.

Outside of the linear ion trap, mass analysis can be effected using a quadrupole or other multipole-based mass analysis, a time of flight mass spectrometer, a Fourier transform mass spectrometer, a conventional 3-dimensional ion trap mass spectrometer, or any other suitable mass spectrometer.

To achieve a high level of separation of the first and second groups of ions, it is necessary to ensure that the energy distribution amongst the ions is sufficiently low, so that energy barrier will retain the second group of ions while permitting the first group of ions to empty or to escape. Accordingly, between steps (1) and (2), the method preferably includes ensuring that this energy distribution is low enough, to provide this separation. More preferably, this is achieved by thermalizing the ions with by collision with a neutral gas.

BRIEF DESCRIPTION OF THE DRAWINGS

For better understanding the present invention and to show more clearly how it may be carried into fact, reference will now be made, by way of example, to the accompanying drawings in which:

FIG. 4 shows a timing diagram for the voltages of the apparatus of FIG. 1, according to the present invention;

DETAILED DESCRIPTION OF THE INVENTION

Figure 1:
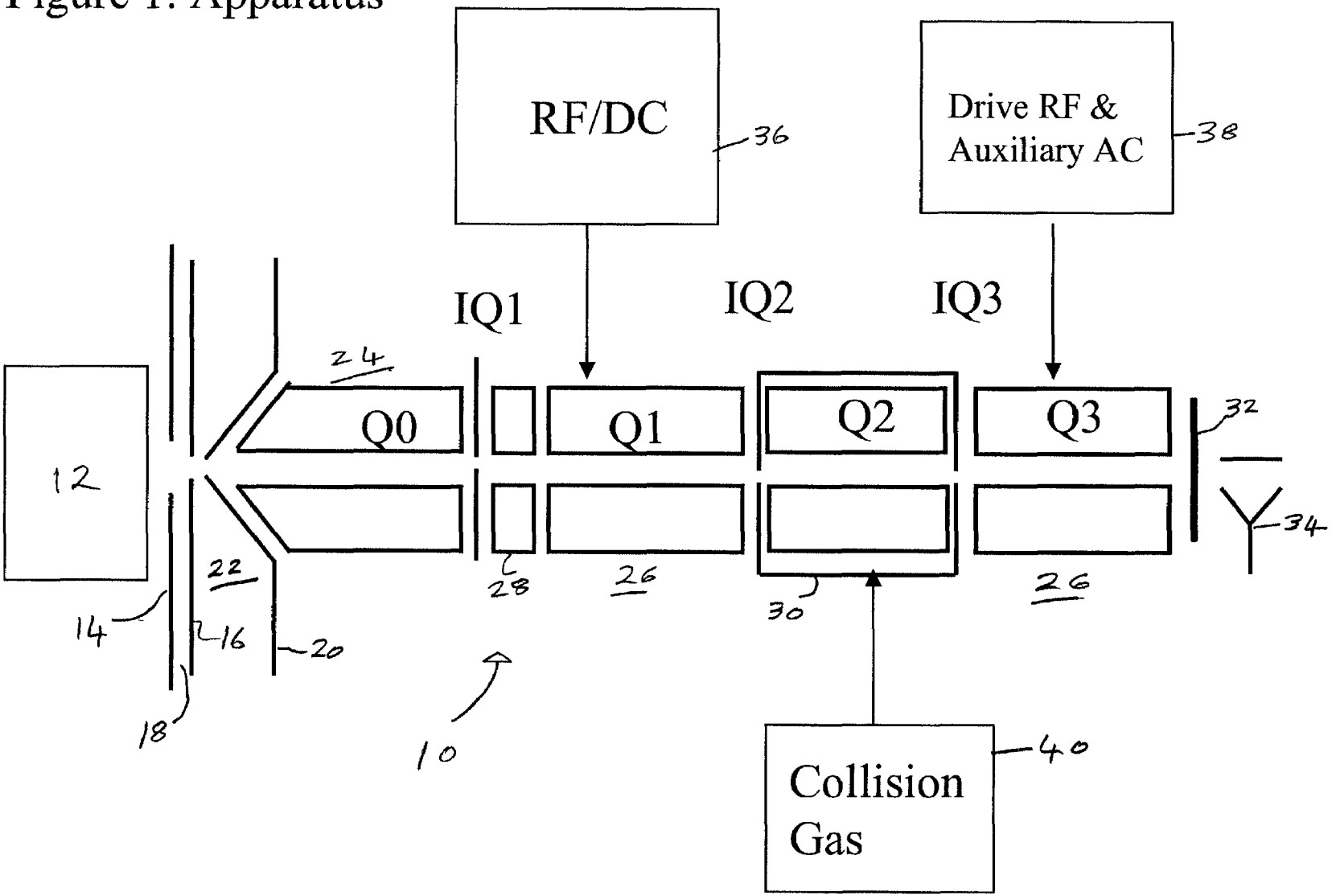
FIG. 1 is a schematic view of a triple quadrupole mass spectrometer for use with the present invention.

Referring first to FIG. 1, there is shown a conventional triple quadrupole mass spectrometer apparatus generally designated by reference 10. An ion source 12, for example an electrospray ion source, generates ions directed towards a curtain plate 14. Behind the curtain plate 14, there is an orifice plate 16, defining an orifice, in known manner.

A curtain chamber 18 is formed between the curtain plate 14 and the orifice plate 16, and a flow of curtain gas reduces the flow of unwanted neutrals into the analyzing sections of the mass spectrometer.

Following the orifice plate 16, there is a skimmer plate 20. An intermediate pressure chamber 22 is define between the orifice plate 16 and the skimmer plate 20 and the pressure in this chamber is typically of the order of 2 Torr.

Ions pass through the skimmer plate 20 into the first chamber of the mass spectrometer, indicated at 24. A quadrupole rod set Q0 is provided in this chamber 24, for collecting and focusing ions. This chamber 24 serves to extract further remains of the solvent from the ion stream, and typically operates under a pressure of 7 mTorr. It provides interface into the analyzing sections of the mass spectrometer.

A first interquad barrier or lens IQ1 separates the chamber 24 from the main mass spectrometer chamber 26 and has an aperture for ions. Adjacent the interquad barrier IQ1, there is a short "stubbies" rod set, or Brubaker lens 28.

A first mass resolving quadrupole rod set Q1 is provided in the chamber 26 for mass selection of a precursor ion. Following the rod set Q1, there is a collision cell of 30 containing a second quadrupole rod set Q2, and following the collision cell 30, there is a third quadrupole rod set Q3 for effecting a second mass analysis step.

The final or third quadrupole rod set Q3 is located in the main quadrupole chamber 26 and subjected to the pressure therein typically $1\times10^{-5}$ Torr. As indicated, the second quadrupole rod set Q2 is contained within an enclosure forming the collision cell 30, so that it can be maintained at a higher pressure; in known manner, this pressure is analyte dependent and could be 5 mTorr. Interquad barriers or lens IQ2 and IQ3 are provided at either end of the collision cell of 30.

Ions leaving Q3 pass through an exit lens 32 to a detector 34. It will be understood by those skilled in the art that the representation of FIG. 1 is schematic, and various additional elements would be provided to complete the apparatus. For example, a variety of power supplies are required for delivering AC and DC voltages to different elements of the apparatus. In addition, a pumping arrangement or scheme is required to maintain the pressures at the desired levels mentioned.

As indicated, a power supply 36 is provided for supplying RF and DC resolving voltages to the first quadrupole rod set Q1. Similarly, a second power supply 38 is provided for supplying drive RF and auxiliary AC voltages to the third quadrupole rod set Q3, for scanning ions axially out of the rod set Q3. A collision gas is supplied, as indicated at 40, to the collision cell 30, for maintaining the desired pressure therein.

The apparatus of FIG. 1 is based on an Applied Biosystems/MDS SCIEX API 2000 triple quadrupole mass spectrometer. In accordance with the present invention, the third quadrupole rod set Q3 is modified to act as a linear ion trap mass spectrometer with the ability to effect axial scanning and ejection as disclosed in U.S. Pat. No. 6,177,668.

The standard scan function, detailed in U.S. Pat. No. 6,177,668 involves operating Q3 as a linear ion trap. Analyte ions are admitted into Q3, trapped and cooled. Then, the ions are mass selectively scanned out through the exit lens 32 to the detector 34. Ions are ejected when their radial secular frequency matches that of a dipolar auxiliary AC signal applied to the rod set Q3 due to the coupling of the radial and axial ion motion in the exit fringing field of the linear ion trap.

Figure 2:
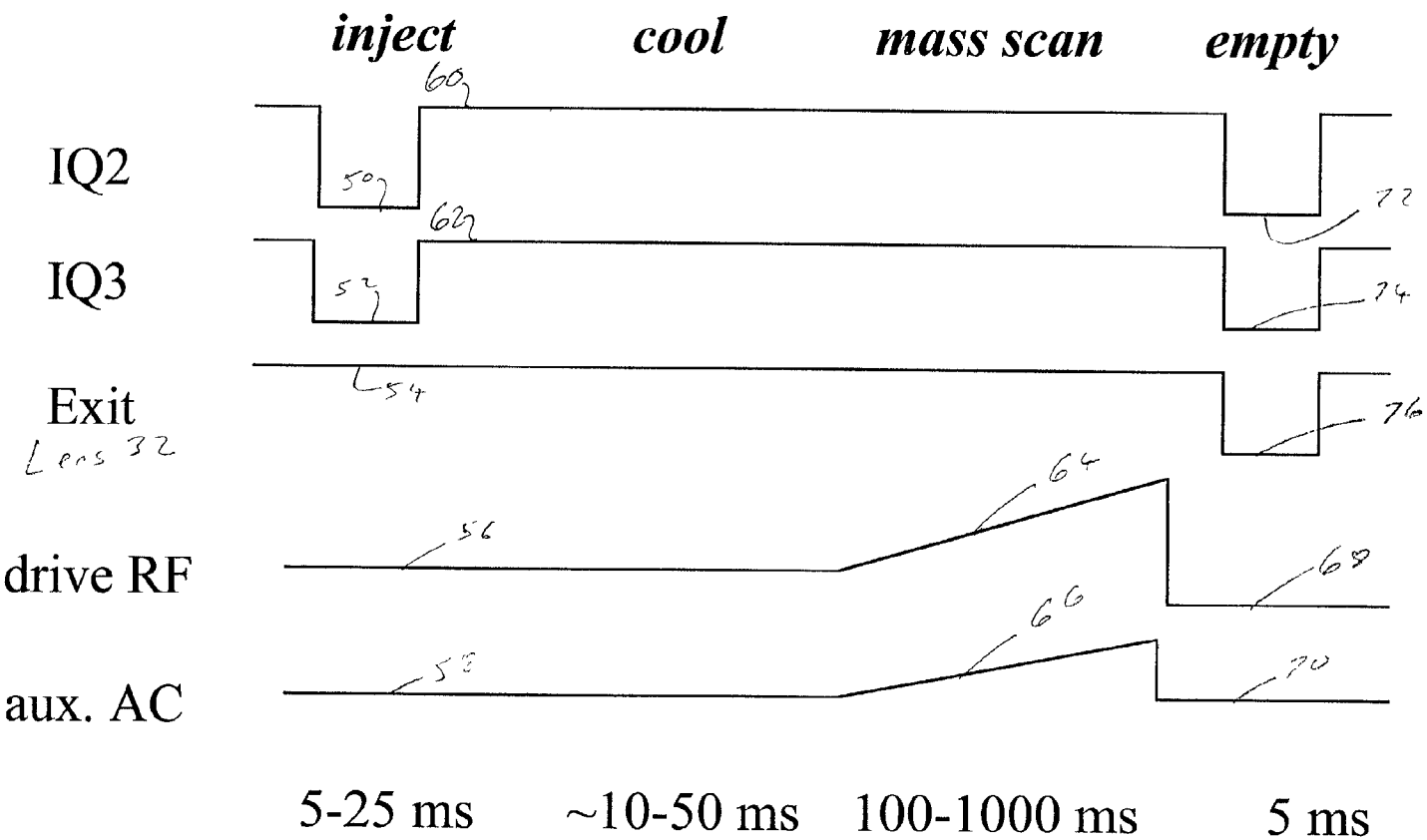
FIG. 2 is a timing diagram showing variation of voltages at different locations within the mass spectrometer of FIG. 1, in conventional operation.

The conventional timing diagram for this scan function is displayed in FIG. 2. In an initial injection phase, the DC voltages at IQ2 and IQ3 are maintained low, as indicated at 50 and 52, while simultaneously the exit lens 32 is maintained at a high DC voltage 54. This allows ions passage through rod sets Q1 and Q2 into Q3, and Q3 functions as an ion trap preventing ions leaving from Q3. At this time, the drive RF and auxiliary AC voltages applied to Q3, are maintained at low voltages indicated at 56 and 58 in FIG. 2. The injection period typically lasts for 5–25 milliseconds.

Following this there is a cooling period, during which voltages IQ2 and IQ3 are raised to levels indicated at 60 and 62, to prevent further passage of ions. The voltage of the exit lens 32 is maintained at the voltage 54. Consequently, ions are completely trapped within Q3, and are prevented from exiting from Q3 in either direction and also are radially confined by the quadrupolar field. The drive RF and auxiliary AC voltages applied to quadrupole rod set Q3 are maintained at levels 56 and 58. This cooling period lasts 10–50 milliseconds.

Once the ions have been cooled to substantially the same energy, the ions are scanned out in a mass scan period, during which the DC voltages on the lens IQ2 and IQ3 are maintained at the high, blocking voltage levels 60, 62 and the exit lens 32 is maintained at the voltage level 54. These voltages are normally sufficient to maintain the ions trapped.

However, in accordance with U.S. Pat. No. 6,177,668, during this mass scan period, the drive RF and auxiliary AC voltages applied to the quadrupole rod set Q3 are scanned as indicated at 64 and 66. This causes ions to be scanned out in a mass selective fashion through the ion lens 32 to the detector 34.

At the end of the mass scanning period, the drive RF and auxiliary AC voltages are returned to zero, as indicated at 68 and 70. Simultaneously, the DC potentials applied to the lens or barriers IQ2 and IQ3 are reduced to zero as indicated at 72 and 74, and correspondingly the voltage on the exit lens 32 is reduced to zero as indicated at 76. This serves to empty the ion trap, formed by Q3, of ions.

In the cooling period, ions are trapped within the linear ion trap formed by Q3, by the radially applied RF voltage and the DC barriers applied to both ends of the device, i.e. at the lens or barrier IQ3 and the exit lens 32. Once ions are trapped in the linear ion trap they experience numerous energy dissipating collisions to the point where the kinetic energy of the trapped ions is determined by the temperature of the surrounding neutral gas in addition to energy from the RF field. The background gas density and the collision cross section of the ion with the background gas determine the time required for this thermalization process. Given enough time a trapped ion population will thermalize even at very low background gas pressures.

Once a trapped ion population containing singly and multiply charged ions has thermalized, the effective DC barrier height at the ends of the linear ion trap depends on the charge state of the ion. Ions will escape if their kinetic energy is greater than their charge state multiplied by the applied repulsive DC voltage. That is, if $$mv^2/2 > qV$$

where, m is the ion mass, v is the ion velocity, q is the ion charge state, and V is the applied repulsive DC voltage.

For example, a DC barrier height of 10 volts appears as a 10 volt repulsive barrier for a singly charged ion, a 20 volt repulsive barrier for a doubly charged ion, and a 30 volt barrier for a triply charged ion. If the DC voltage applied to one or both ends of the linear ion trap is reduced to the point at which it is similar to the kinetic energies of the thermalized trapped ion population, some ions will escape, but in a charge state dependent manner. For example, if the DC trapping voltage applied to one of IQ3 and the exit lens 32 of the linear ion trap of Q3 is reduced to 1 volt for a mixed charge state ion population that has been thermalized to a kinetic energy of 1.5 electron volt, the singly charged ions will preferentially escape from the linear ion trap enhancing the relative concentration of ions with higher charge states since the higher charge states see proportionately higher effective barriers due to the applied 1 volt repulsive DC voltage. Optimization of the repulsive barrier height can result in removal of most singly charged ions from an original ion population in which they were the dominant trapped species.

It is understood that the trapped ion population will be characterized by an energy distribution rather than a single energy. If completely thermalized this energy distribution will be close to a Maxwell-Boltzmann distribution characterized by the temperature of the neutral gas within the linear ion trap in addition to energy from the RF field. The implication is that each trapped ion will have a slightly different kinetic energy. Thus, it is unlikely that complete elimination of lower charge state ions from the linear ion trap can be accomplished at room temperature. However, enhancement of higher charge state ions relative to singly charged ions will occur. The trapped ion population within the linear ion trap need not be completely thermalized to affect some degree of charge state separation. However, the relative enhancement of the population of multiply charged ions to singly charged ions will not be as great since the multiply charged ions will in general be more energetic than the singly charged ions.

Figure 3:
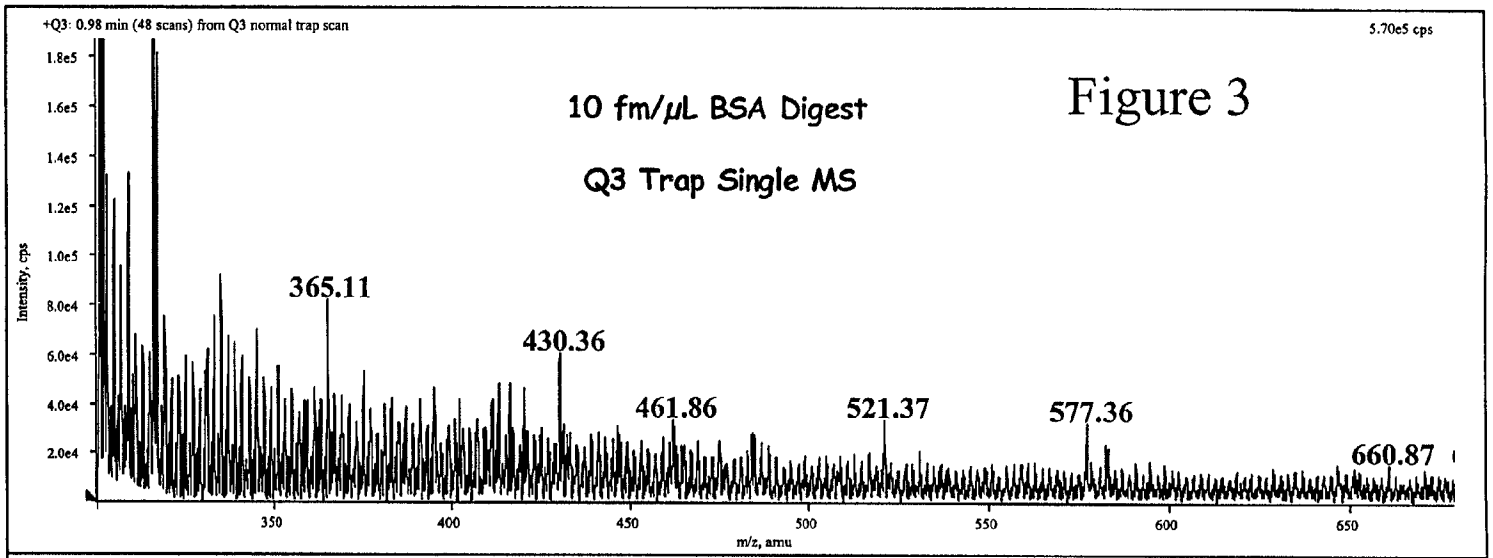
FIG. 3 shows a single MS survey scan utilizing the mass spectrometer of FIG. 1 in a single MS mode.

Referring now to FIG. 3, this shows a single MS survey scan of a tryptic digest of 10 fm/micro-liter of bovine serum albumin (BSA). This spectrum was obtained by operating the Q1 quadrupole rod set in RF-only mode in order to transmit most of the ions from the ion source into the Q3 ion trap. The q2 collision cell was maintained at approximately 5 milli-Torr of nitrogen to enhance the trapping efficiency of Q3, and potentials along the mass spectrometer 10 were selected to give desired ion movement without any significant fragmentation. Thus, the DC voltage offset between Q1 and q2 was maintained at less than 10 volts in order to maximize the Q3 trapping efficiency. The mass spectrum in FIG. 3 shows the presence of many singly charged ion species with no easily recognizable multiply charged peptide features.

Reference will now be made to FIG. 4 which shows a timing diagram similar to FIG. 2, but modified according to the present invention. For simplicity and brevity, like elements of FIG. 4 are given the same reference numeral as in FIG. 2, and description of these time periods is not repeated.

The timing scheme of FIG. 4 has the same four periods as in FIG. 2, namely an initial injection period during which ions are passed through Q1 and Q2 into Q3, a cooling period during which ions are trapped in Q3 and caused to cool down to an approximate uniform level; at the end of the timing diagram, there is the mass scanning period and the emptying time period. What is additionally provided is the separation or partial emptying period indicated at 80. During this period, the DC voltage applied to the IQ3 lens or barrier is reduced to a point where the trapped singly charged ions are allowed to escape while retaining the multiply charged ions within the linear ion trap of Q3. As is explained above, because of the different charges of the ions and because the ions have been cooled to approximately the same energy, this enables unwanted singly charged ions to be ejected from the ion trap while retaining desired, multiply charged ions.

Note that it is possible to eject ions from the ion trap at Q3 by reducing the voltage on either IQ3 or the exit lens 32. It is preferred to reduce the potential barrier at IQ3, since this prevents the ions hitting the ion detector which shortens the ion detector lifetime.

A multiply charged enhancement scan, in accordance with the present invention, was then carried out by again filling the Q3 ion trap with ions from the electrospray ion source, allowing the trapped ion population within the Q3 linear ion trap to thermalize, and then providing a "separation" or "partial empty" step in which the IQ3 barrier was reduced as indicated at 80 in FIG. 4. Again, ions were admitted into the Q3 linear ion trap by reducing the DC voltage applied to the IQ3 lens while the Exit lens 32 was maintained at an appropriate repulsive voltage with respect to the incoming ion energies for a period of 100–1000 ms. The ions were trapped and cooled within the Q3 linear ion trap as before, for a period in the range 10–50 milliseconds, by collision with the residual background gas. The separation step at 80 of FIG. 4 was accomplished by reducing the repulsive DC voltage applied to IQ3 to the point at which the singly charged ions can escape while ions with higher charge states remain trapped, for a period of 1–50 milliseconds. Mass analysis of the trap contents was carried out for a period of 100–1000 ms. Again, the final step expelled or emptied any residual trapped ions from the linear ion trap in an empty step of duration 5 ms.

Figure 5:
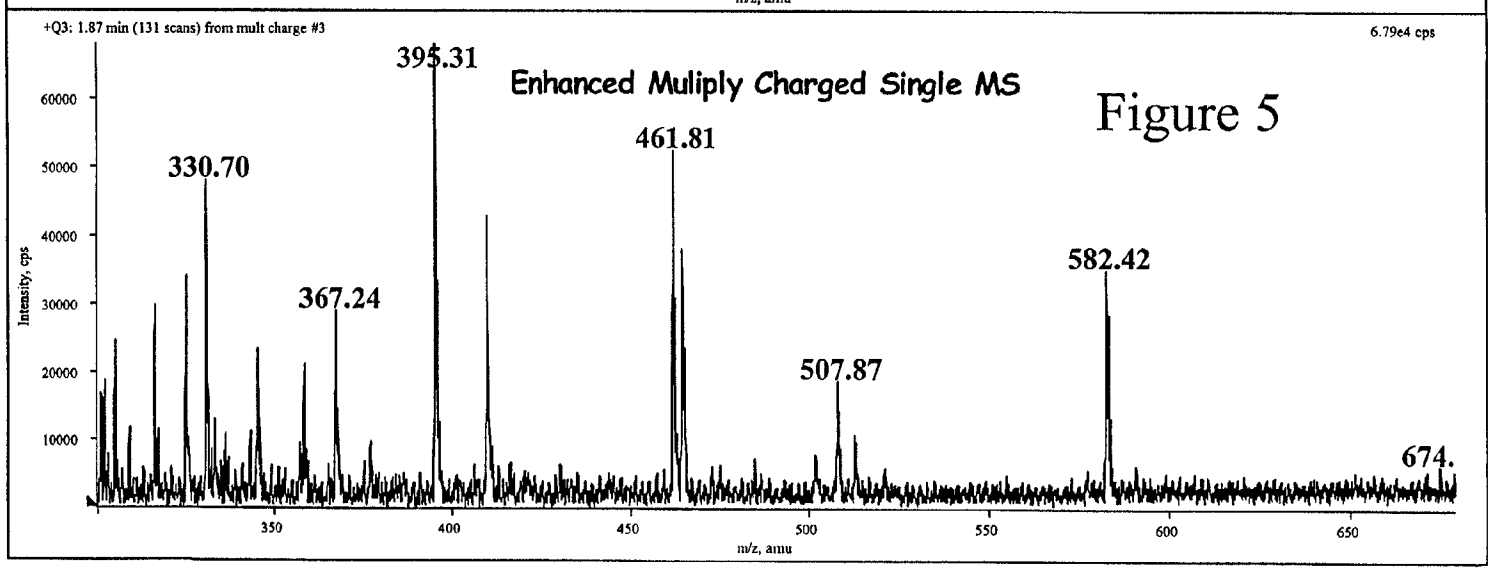
FIG. 5 shows a single MS survey scan, similar to FIG. 3, but with the mass spectrometer operated in accordance with FIG. 4, separating multiply charged ions from singly charged ions.

Implementation of the multiply charged enhancement scan results in the survey mass spectrum shown in FIG. 5 for the same 10 fm/micro-liter BSA digest solution as to FIG. 3. In FIG. 5, all of the major mass peaks in the spectrum are due to doubly charged BSA peptides, which are easily distinguished from the very low level singly charged noise. Thus, the data obtained from the multiply charged enhancement scan mode displays significantly better signal-to-noise ratios than the conventional single MS survey scan of FIG. 3, allowing very easy identification of multiply charged peptides.

Figure 6:
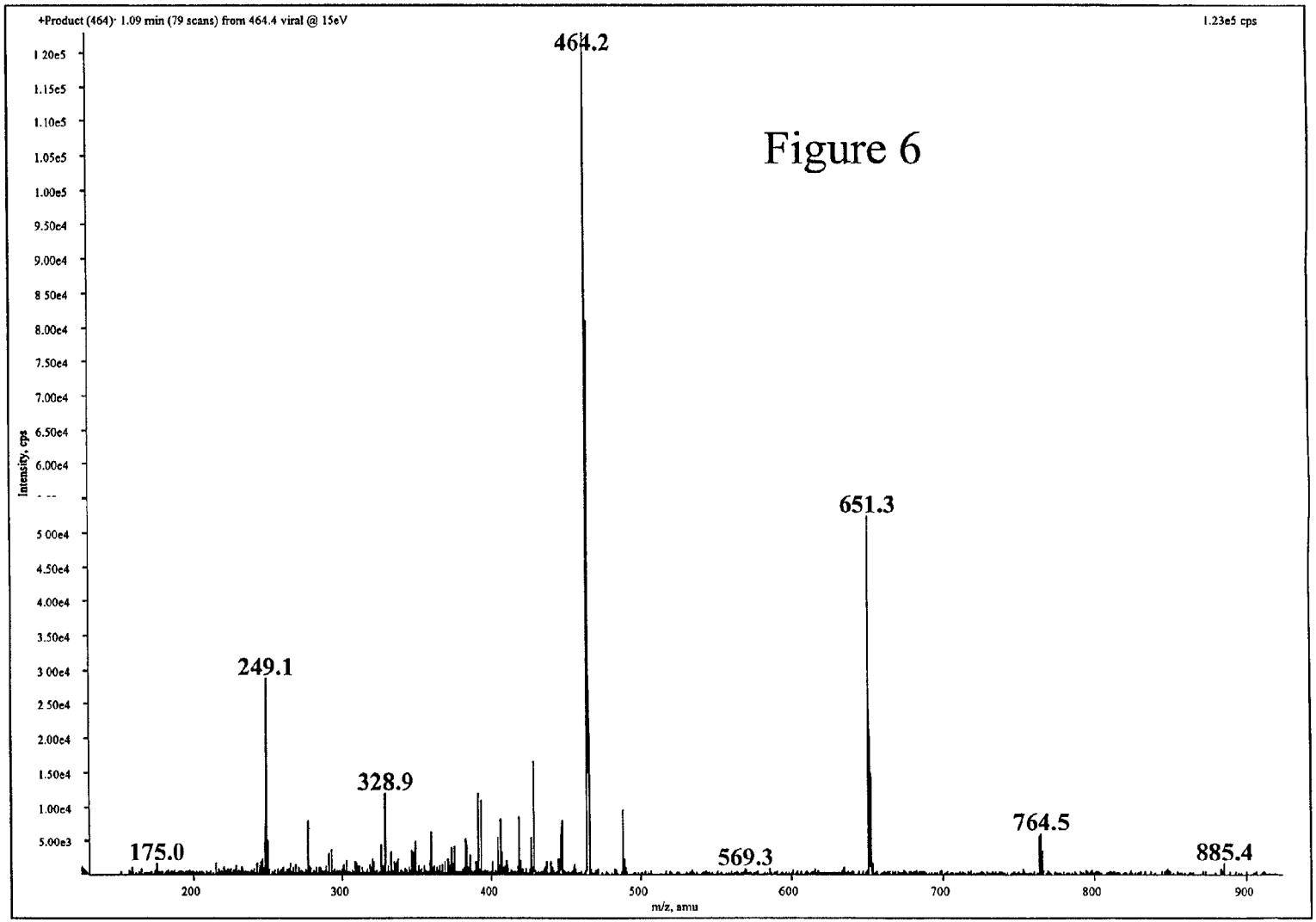
FIG. 6 shows an exemplary MS/MS scan in accordance with the present invention.

Once the ions of interest have been identified, conventional product ion MS/MS scans can be conducted on selected peptides as is shown in FIG. 6. This is the product ion mass spectrum obtained by selecting the doubly charged BSA tryptic peptide located at m/z 464, fragmenting the m/z 464 precursor ions by acceleration between Q1 and q2, trapping the fragment and residual precursor ions in the Q3 ion trap, and finally mass selectively scanning the trapped ions toward the detector.

Figure 7:
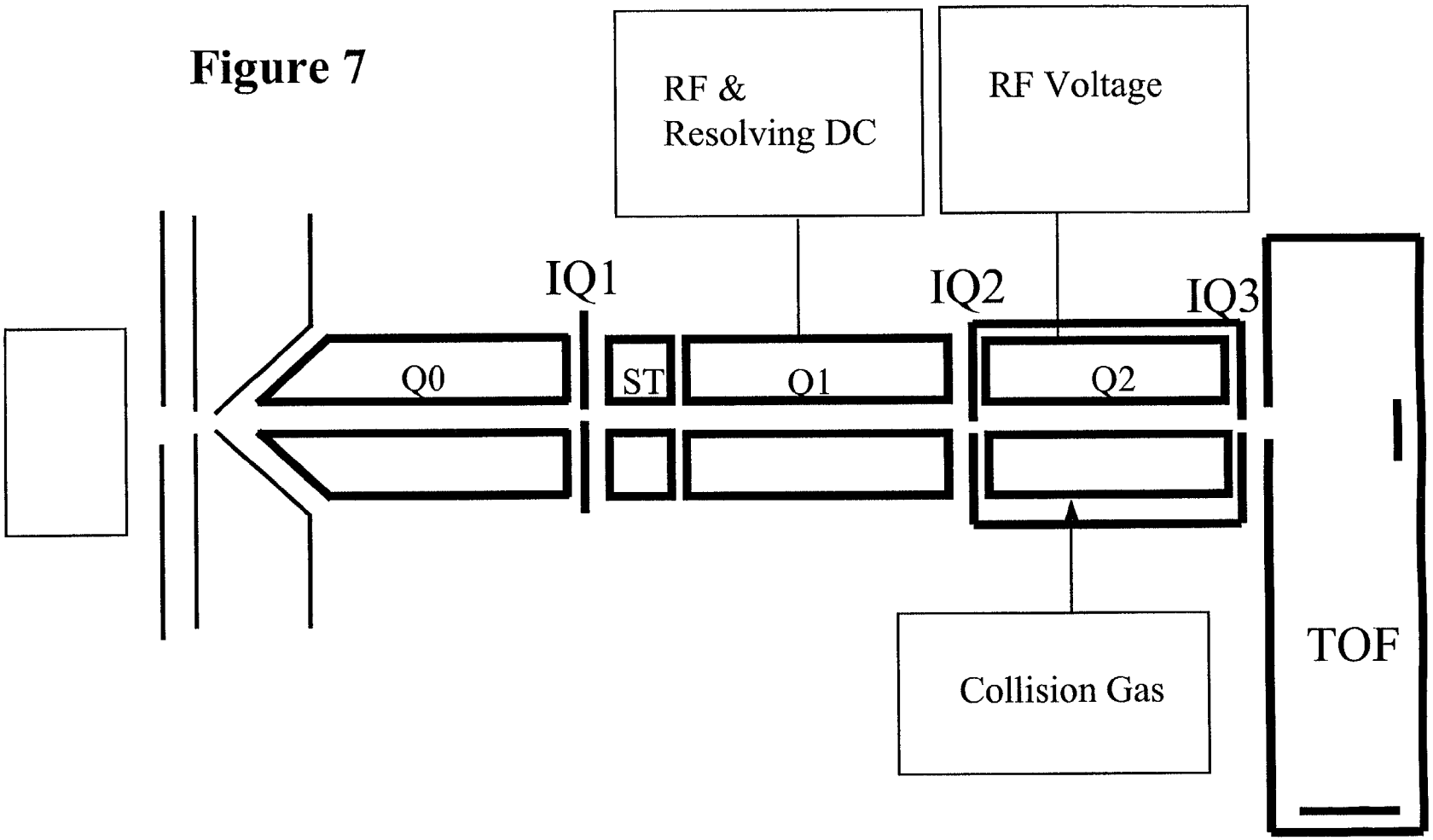
FIG. 7 shows schematically a Qq-TOF mass spectrometer for use with the present invention.

The multiply charged enhancement scan mode or method of the present invention is not restricted to apparatus employing a mass selective linear ion trap. Any mass spectrometer system that has the capability of trapping ions in a linear or curved multipole ion trap can be used. A straightforward example of an alternative implementation of the present invention is the use of the Q2 collision cell of a Q-q-time-of-flight (TOF) tandem mass spectrometer as is schematically displayed in FIG. 7 (Q designating a mass analysis section and q a collision cell). Ions may be trapped within the Q2 linear ion trap by reducing the voltage applied to IQ2 while maintaining IQ3 at a sufficiently high repulsive DC voltage during a specified fill time. The voltage applied to IQ2 is then increased to trap an ion population within Q2. The ions within the Q2 linear ion trap are thermalized quickly due to the milli-torr pressures in a conventional Q2 collision cell. Next, the repulsive DC barrier applied to IQ2, IQ3 or both lenses is reduced to the point where the lower charge state ions are allowed to escape. The remaining trapped ion population within the Q2 linear ion trap is then pulsed out toward the TOF mass spectrometer for conventional mass analysis resulting in a mass spectrum in which the appearance of higher charge state ions has been enhanced.

Since the Q-q-TOF instrument provides very rapid full mass spectra the identities of all of the ions originally trapped within the Q2 linear ion trap can be ascertained by reducing the repulsive DC barrier applied to IQ3 in a step wise fashion. The first ions to escape will be singly charged followed by the doubly charged ions, multiply charged ions, etc. If the rate at which the repulsive DC voltage applied to IQ3 is slower than the TOF scan time, mass spectra can be obtained at each value of the IQ3 barrier height. Thus, none of the ions trapped within the Q2 linear ion trap will have been wasted and charge state separation will have been accomplished.

Figure 8:
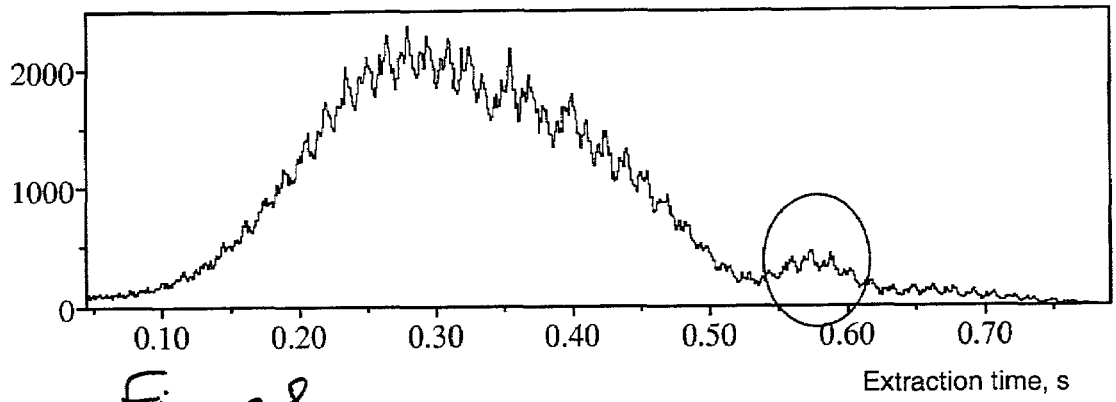
FIG. 8 shows the total ion signal of a Qq-TOF instrument obtained as the IQ3 lens voltage is reduced from 9.7 to 8.5 volts.

An example of the method for charge state separation using a Qq-TOF instrument is shown in FIG. 8. Here, electrosprayed ions from a tryptic digest of bovine serum albumin were trapped in Q2 and then allowed to escape by a step-wise reduction of the voltage applied to IQ3. The IQ3 voltage was reduced from 9.7 to 8.5 volts with a DC offset of 8.5 volts applied to Q2. Thus, the DC barrier height was reduced from 1.2 volts to 0 volts uniformly during the time taken for the experiment. An axial field had been applied to concentrate the trapped ion population toward IQ3. FIG. 8 shows the total ion signal as a function of the time over which the IQ3 voltage was reduced.

As shown, as the voltage on IQ3 is progressively reduced, ions begin to leak out at an increasing rate, which peaks at approximately 0.27 seconds and declines down to a minimum at approximately 0.5 seconds, this being primarily singly charged ions escaping. After 0.50 seconds, as the barrier is deceased further, another small peak occurs, as indicated by the circled area, this being primarily the doubly charged ions escaping from the ion trap.

Figure 9:
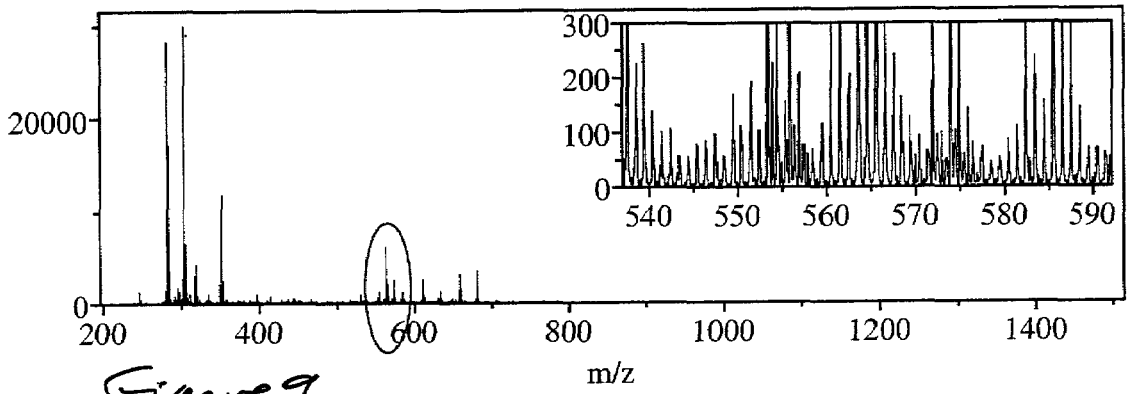
FIG. 9 shows the summed mass spectra comprising the total ion signal in FIG. 8, with the inset being an expanded view of m/z 535 to 595.

FIG. 9 shows the summed TOF mass spectra for the entire ion population of FIG. 8. These mass spectra are comprised of singly and multiply charged ions. The FIG. 9 inset is an expanded view of the m/z 535 to 595 region illustrating the complicated nature of the mass spectra.

Figure 10:
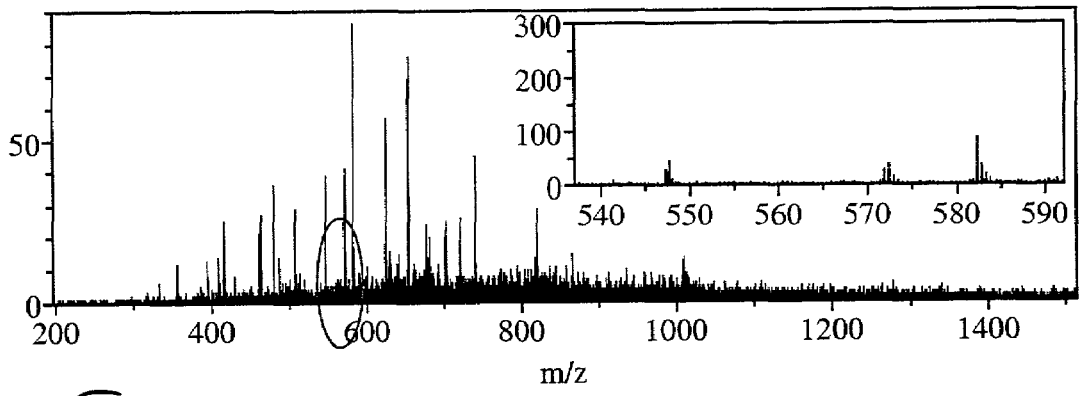
FIG. 10 shows the summed mass spectra for the circled region of FIG. 8, with the inset being an expanded view of m/z 535 to 595 and showing that the singly charged ions have been discriminated against leaving only multiply charged ions.

FIG. 10 shows the mass spectra obtained from the circled portion of the total ion signal of FIG. 8. These spectra contain mostly multiply charged ions with very little contribution from singly charged ions. The inset of FIG. 10 more clearly shows the spectral simplification in the same m/z 535 to 595 mass range highlighted in FIG. 9. The only prominent ions in the FIG. 10 inset are multiply charged. These multiply charged ions would be difficult to identify in the FIG. 9 mass spectra.

DC barriers over which the lower charge state ions are allowed to escape can be created with ion optical elements other than a simple aperture lens. DC barriers can be created by another multipole device such as a quadrupole or a Brubaker lens with a suitable DC barrier applied to it. DC barriers have also been created by cylindrical ring electrodes placed around linear multipole ion traps as demonstrated by Gerlich [*D. Gerlich, Advances in Chemical Physics, Vol. LXXXII,* 1–176 (1992)]. These ion optical elements can be used in place of, or in addition to, simple aperture lenses.

DC barriers can also be created using properly shaped rods used to define the linear ion trap itself or via auxiliary electrodes inserted between the linear ion trap rods as described by Thomson and Jolliffe U.S. Pat. No. 5,847,386. These techniques offer the opportunity to create a continuous DC barrier or field within the linear ion trap itself and may lead to more efficient charge state discrimination.

It is also possible that for some applications, trapping may not be required. Trapping is provided here to ensure that there is sufficient time to thermalize or cool all the ions to substantially the same energy level. In certain mass spectrometer systems, it may be possible to achieve this in continuous flow through devices. This would require, for example, that transit time through a cooling section and the number of collisions be sufficient to ensure that all ions are substantially thermalized at the end of the cooling section where an energy barrier is provided.

The invention claimed is:

1. A method of analyzing ions to enhance the separation of groups of ions with different charge states, the method comprising:

(1) providing a stream of ions, wherein the stream of ions includes at least a first group of ions having a first charge state and a second group of ions having a second charge state and injecting at least a portion of the stream of ions into an ion processing section for an injection period;

(2) trapping at least some of the injected ions in the ion processing section in an axial direction of the ion processing section;

(3) thermalizing the trapped ions; and (4) providing, in the ion processing section, an energy barrier having a barrier magnitude that is constant for at least a separation time period, wherein, during the separation time period:

(a) the energy barrier has a first effective barrier height with respect to ions in the first group, wherein the first effective barrier height is equal to the first charge state multiplied by the barrier magnitude, and wherein the first effective barrier height is less than the kinetic energy of the first group of ions; and (b) the energy barrier has a second effective barrier height with respect to ions in the second group, wherein the second effective barrier height is equal to the second charge state multiplied by the barrier magnitude, and wherein the second effective barrier height is greater than the kinetic energy of the second group of ions, thereby allowing ions in the first group to preferentially escape from the ion processing section.

2. A method as claimed in claim 1 which includes, in step (3), ensuring that the energy distribution amongst the ions is sufficiently low to provide adequate separation between the first and second groups of ions, allowing a substantial portion of the first group of ions to escape from the ion processing section and trapping a substantial portion of the second group of ions in the ion processing section.

3. A method as claimed in claim 2, which includes, in step (3), thermalizing the ions by collision with a neutral gas.

4. A method as claimed in claim 2 or 3, which includes, after allowing ions in the first group to escape from the ion processing section, subjecting the second group of ions to mass analysis.

5. A method as claimed is claim 4 which includes providing a quadrupole rod set in the ion processing section and effecting said mass analysis within the quadrupole rod set.

6. A method as claimed in claim 5, which includes effecting mass analysis in the processing section by scanning the second group of ions out of the quadrupole rod set by axial ejection.

7. A method as claimed in claim 6, which includes, after scanning out the second group of ions from the quadrupole rod set to effect mass analysis, applying voltages to the ion trap, to empty the ion trap.

8. A method as claimed in claim 2 or 3, which includes effecting mass analysis on the first group of ions.

9. A method as claimed in claim 8 which includes effecting said mass analysis using a multipole rod set.

10. A method as claimed in claim 9, which includes effecting said mass analysis using a quadrupole rod set.

11. A method as claimed in claim 8, which includes effecting said mass analysis in a time of flight mass spectrometer.

12. A method as claimed in claim 8, which includes effecting said mass analysis using a Fourier transform mass spectrometer.

13. A method as claimed in claim 8, which includes effecting said mass analysis using a 3-dimensional ion trap mass spectrometer.

14. A method as claimed in claim 8, which includes, operating the ion processing section as an ion trap, the method comprising:

(i) In step (1), injecting a stream of ions into the processing section for an injection period; and (ii) In step (2), terminating supply of ions to the processing section, and thermalizing ions in the ion processing section.

15. A method as claimed in claim 8, which includes:

(a) injecting a stream of ions into the processing section for an injection period, providing the energy barrier to permit the first group of ions to be substantially emptied from the processing section for mass analysis;

(b) resetting the energy barrier to a lower level to permit a subsequent group of ions having a higher charge to be substantially emptied from the processing section, for separate mass analysis; and (c) repeating steps (a) and (b) to enable mass analysis of each of a plurality of groups of ions having different charges.

16. A method as claimed in claim 15, which includes:

(a) providing for injection of the stream of ions, in step (1), into the processing section, and ensuring that the ions in the processing section have said sufficiently low energy distribution; and (b) after all desired groups of ions have been emptied from the processing section for mass analysis, repeating the step of injecting ions into the processing section, to provide further ions for analysis.

17. A method as claimed in claim 4, which includes, prior to supplying the stream of ions to the processing section, generating a stream of ions of an analyte, mass selecting a desired m/z of an analyte ion in a first mass analysis step, and injecting the desired ion into the processing section for analysis, wherein the mass analysis of the second group of ions comprises a second mass analysis step.

18. A method as claimed in claim 17, which includes, in the first mass analysis step mass selecting a precursor ion as the desired ion, subjecting the precursor ion to a collisional process to generate fragment ions, and passing the fragment ions and any remaining precursor ions into the processing section.

19. A method as claimed in claim 18, which includes effecting said second mass analysis step in the processing section, to mass analyze said second group of ions.

20. A method as claimed in claim 18, which includes mass analyzing said at least to first group of ions having a first charge externally to the processing section.

21. A method as claimed in claim 20, which includes effecting the second mass analysis step in one of a multipole mass spectrometer, a quadrupole mass spectrometer, a time of flight mass spectrometer, and a Fourier transform mass spectrometer.

22. A method as claimed in claim 20, which includes:

(a) injecting a stream of ions into the processing section for an injection period, providing an energy barrier to permit a first group of ions having a first charge to be emptied from the processing section for mass analysis;

(b) resetting the energy barrier to a lower level to permit a subsequent group of ions having a higher charge to be emptied from the processing section for mass analysis; and (c) repeating steps (a) and (b) to enable mass analysis of each of a plurality of groups of ions having different charges.

23. A method as claimed in claim 1 wherein the length of the separation time period is between 1 to 50 ms.

* * * * *